United States Patent [19]

Peebles et al.

[11] 4,336,283

[45] Jun. 22, 1982

[54] PLASTICIZATION OF CARBON FIBERS

[75] Inventors: Leighton H. Peebles, Medfield; Donald R. Uhlmann, Newton; Steven B. Warner, Brighton, all of Mass.

[73] Assignee: The United States of America as represented by the Secretary of the Navy, Washington, D.C.

[21] Appl. No.: 714,542

[22] Filed: Aug. 16, 1976

Related U.S. Application Data

[63] Continuation-in-part of Ser. No. 471,942, May 21, 1974, abandoned.

[51] Int. Cl.[3] ..... B05D 3/10

[52] U.S. Cl. ..... 427/154; 8/115.5; 8/115.6; 423/460; 427/255.1; 427/255.4; 427/299; 427/309; 427/399; 427/444

[58] Field of Search ..... 427/444, 299, 399, 309, 427/113, 248, 154, 248.1, 255.1, 255.4; 8/115.5, 115.6; 423/460

[56] References Cited

U.S. PATENT DOCUMENTS

| | | | |
|---|---|---|---|
| 2,551,344 | 5/1951 | Scholl | 204/30 |
| 3,031,342 | 4/1962 | Kertesz | 427/372.2 |
| 3,294,572 | 2/1966 | Piccione et al. | 427/299 |
| 3,413,094 | 11/1968 | Gibson | 423/461 |
| 3,459,588 | 8/1969 | Davis | 428/224 |
| 3,556,729 | 1/1971 | Holsten et al. | 8/115.5 |
| 3,650,820 | 3/1972 | DiPietro | 427/391 |
| 3,660,140 | 5/1972 | Scola et al. | 427/299 |
| 3,801,350 | 4/1974 | Dauksys | 427/350 |
| 3,801,351 | 4/1974 | Dauksys | 427/302 |
| 3,885,007 | 5/1975 | Olsen et al. | 423/460 |
| 3,894,884 | 7/1975 | Druin et al. | 423/460 |

OTHER PUBLICATIONS

Chemical Abstracts, vol. 80, 1974, p. 146642j.
Chemical Abstracts, vol. 75, 1971, p. 51018t.

*Primary Examiner*—Norman Morgenstern
*Assistant Examiner*—Janyce A. Bell
*Attorney, Agent, or Firm*—R. S. Sciascia; A. L. Branning; R. D. Johnson

[57] ABSTRACT

An improved method of manufacturing articles containing carbon fibers wherein the fibers are temporarily plasticized to render them more flexible thereby permitting tortuous mechanical manipulation of the fibers to be carried out with little or no mechanical damage. The improvement comprises exposing the carbon fibers to agents capable of intercalating single crystals of graphite, such as bromine or iodine monochloride which have the effect of plasticizing the fibers by lowering their tensile modulus. While the fiber yarns are appreciably more flexible in the plasticized state, and have a higher elongation-at-break, on removal of the plasticizer they tend to return to their original state but retain a measurable degree of the shape imparted to them.

23 Claims, No Drawings

PLASTICIZATION OF CARBON FIBERS

CROSS REFERENCE TO COPENDING APPLICATION

This is a continuation-in-part of application Ser. No. 471,942, filed May 21, 1974, now abandoned.

BACKGROUND OF THE INVENTION

The present invention concerns carbon fibers and, more particularly, a process for rendering such fibers sufficiently flexible to permit tortuous mechanical manipulations to be performed on them with little or no mechanical damage. Carbon fibers plasticized according to the present invention possess a higher elongation-at-break.

Carbon fibers find extensive application in the manufacture of "ablative" materials, usually composites made of carbon or graphite tape impregnated with phenolic resin and then formed into the desired shape. In fabric form, these fibers may be used as heating elements in various applications. Carbon or graphite felt is used as a high temperature insulation. Graphite yarn is used to make heat- and corrosion-resistant packing materials.

More recent applications for carbon and graphite fibers are in structural materials in which the carbon filaments are used to reinforce epoxy or other tough resins. Structural materials such as compressor blades for jet engines, aircraft wings, tail or fuselage structures and helicopter rotor blades have been produced from this type of composite.

Composites of the type just described have a high tensile modulus and tensile strength in the fiber direction yet have a relatively low impact strength typical of high modulus, brittle materials. The impact resistance of these composites could be materially improved with only a small loss in modulus and strength if the elongation-at-break could be increased.

Carbon fibers require special care during process operations because the individual filaments in the yarn tend to break easily. The partial breakage of filaments results in a yarn which contains many stray filaments oriented at various angles from the main direction of the yarn. A yarn containing stray filaments has an abraded, hairy appearance rather than that of a smooth coherent bundle. As a yarn containing such stray filaments is processed further, small bits of the stray material are broken off to form an aerosol of very short carbon fibers, sometimes called "fly," whose presence in the manufacturing plant is harmful to personnel and to machinery.

To avoid the breakage of filaments and minimize the production of "fly," the carbon yarn is generally processed more gently than ordinary textile fibers. Typically, it is shaped relatively slowly over large rollers and the lateral direction of travel is not abruptly changed during take-up onto a spool or bobbin. These procedures hinder the economic rate of production and, additionally, yarns or tows of carbon fibers cannot be shaped over sharp bends or easily manipulated into configurations which require tight packing such as in woven cloth. The brittle nature of the carbon fibers limits their use to structures wherein good collimation can be obtained with little mechanical damage. Thus, while it is possible to weave carbon fibers into cloth for use in the preparation of composites such a procedure is inexpedient due to economic factors. Accordingly, in the manufacture of articles containing carbon fibers, it has generally been the practice in the art to fabricate the carbon fiber precursor in the desired form of the final product- by weaving, for example- prior to pyrolysis. However, a process in which a single fiber or yarn could be pyrolyzed and then easily woven into a given form would be desirable because of the relative ease of pyrolysis of a single fiber or yarn precursor as compared to a cloth precursor.

The treatment of carbon fibers with agents which fall within the class of materials which will intercalate single crystals of graphite has been disclosed in the prior art. For example, nitric acid has been used to treat carbon fibers to improve the bonding thereof with the supporting matrix in a composite material. Such a process is disclosed by Scola et al in U.S. Pat. No. 3,660,140. Also, bromine has been used to treat carbon fibers for the purpose of enhancing the tensile strength thereof, as disclosed by Deitz in U.S. Pat. No. 3,931,392. However, nowhere in the prior art has there been reported a general procedure for plasticizing carbon fibers by contacting the fibers with an agent which is capable of intercalating single crystals of graphite.

SUMMARY OF THE INVENTION

Accordingly, it is an object of the present invention to provide an improved method for the manufacture of articles containing carbon fibers.

Another object of the invention is to provide a simplified process for plasticizing carbon fibers.

A further object of the present invention is to render carbon fibers appreciably more flexible than in their natural state, thus permitting the fibers to undergo tortuous mechnical manipulation with little or no mechanical damage.

Yet another object of the invention is to provide a process for at least temporarily plasticizing carbon fibers so that configurations such as a permanent crimp can be imparted to them.

It is also an object of the present invention to provide a process for preparing composites with an improved impact resistance.

These objects are accomplished by a method wherein carbon fibers are contacted with a plasticizing agent capable of intercalating single crystals of graphite, thereby permitting the fibers to safely undergo tortuous mechanical manipulations which would normally cause significant breakage in unplasticized carbon fibers. Carbon fibers which are plasticized according to the method of the present invention are especially useful in the preparation of carbon fiber composites which are characterized by high impact resistance as compared to composites produced heretofore by the methods of the prior art.

Other objects, advantages and novel features of the invention will become apparent from the following description thereof.

DESCRIPTION OF THE PREFERRED EMBODIMENTS

In accordance with the present invention an improved method is provided for the manufacture of articles containing carbon fibers wherein the fibers are subjected to tortuous mechanical manipulation in order to impart a particular configuration thereto. The present invention may be successfully employed in the preparation of carbon fiber composites and especially where carbon fibers are woven to make a cloth which is then impregnated with a suitable resin matrix. More specifically, the improvement comprises contacting the carbon fibers prior to the mechanical manipulation thereof with a plasticizing agent which is characterized by having the capability of intercalating single crystals of graphite. The carbon fibers may then have any desired configuration imparted thereto. Subsequently, the plasticizing agent may be removed and the carbon fiber will retain to a measurable degree the configuration imparted thereto during the manipulation. Alternatively, a portion of the plasticizing agent may be left in the fiber to improve the impact resistance thereof.

As used herein, the expression "carbon fiber" is intended to signify in general all fibers which have been heat treated to temperatures substantially higher than the decomposition temperature of the precursor polymer, and include carbon or graphite filamentary material available in any elongated textile form such as yarns, braids, felts, etc., or in monofilament form. Carbon fibers are usually 80 to 95 percent elemental carbon whereas graphite fibers are approximately 99 percent carbon.

The expression "tortuous mechanical manipulation," as used herein, is intended to signify those textile processes such as spinning or weaving, or any other operation such as winding on a bobbin or a mandrel which would ordinarily cause unplasticized carbon fibers to break.

The expression "intercalating agent," as used herein, signifies an element or compound that causes single crystals of graphite to swell and to increase in weight.

The term "elongation-at-break" signifies the deformation of a fiber in the direction of load caused by a tensile force. It is normally expressed as a percentage of the original length of the fiber.

Intercalating agents which produce especially satisfactory results in plasticizing carbon fibers according to the method of the present invention are bromine and iodine monochloride. These materials lower the modulus of the fibers so that in the plasticized state the fiber yarns are appreciably more flexible than in their unplasticized state, have a higher elongation, and can be made to take shapes which would cause the unplasticized material to break. The plasticizing agent can subsequently be removed from the fibers by heating them to modest temperatures, e.g., in the range of 125° C. Alternately, the plasticizer can be left in the fiber or only partly removed to improve elongation-at-break. When these plasticized fibers having improved elongation-at-break are incorporated into a composite, the resultant article has improved impact resistance as compared to prior art carbon fiber composites.

It is well established that single crystals of graphite swell in the presence of intercalation agents which form a layer of the agent between the graphite layer planes. Intercalated single crystals of graphite exhibit exfoliation and can increase in size by factors as large at 10 to 100 when heated under vacuum following the intercalation treatment with bromine or iodine monochloride. In contrast, the carbon fibers processed according to the present invention do not exhibit exfoliation but return to their original dimensions upon removal of the plasticizing agents. After such return and removal, however, the fibers substantially retain the shapes which were imparted to them when they were in the plasticized state. Hence, configurations such as a permanent crimp can, by the process of the present invention, be imparted to carbon fibers.

Both bromine and iodine monochloride yield similar results as plasticizing agents. Reaction of the plasticizing agents may be obtained in both the liquid and vapor states, but exposure to the liquid requires substantially less time, typically in the range of 5 minutes or less total time, for useful results to be obtained. Treatment with bromine may be carried out at room temperature; however, mild heating to a temperature of about 30° C. during plasticization is required with iodine monochloride for similar results to be obtained. An increase in temperature decreases the time required for useful plasticization to be achieved. Plasticization can also be effected when the agents, such as bromine or iodine monochloride, are dissolved in a suitable solvent such as nitromethane. Typical treatment temperatures may range anywhere from about 20° C. to about 350° C.

The plasticiaing agent can be removed from the fiber by exposure to a quartz-iodine lamp for periods of a few minutes or by heating in an air oven at 125° C. for several hours. Any method that is suitable for removing an intercalation agent from graphite single crystals would also be suitable for removing the plasticizing agent from carbon fibers. Such methods include volatilizing the agent by means of vacuum or heat or by solution or chemical reaction with a suitable reagent.

The mechanism of plasticization is believed to result from or be made possible by a swelling associated with the plasticizing medium entering the fiber. In the swelled state, the fiber can be stressed to cause structural rearrangements. After the plasticizing medium is removed, the fibers retain a portion of the shape which was imparted to them. A quantitative measure of the shape retention is given by the crimp index.

The crimp index is defined here as the decrease in length of a fiber in the helical form hanging under its own weight divided by the original length. A crimp index of zero implies that no permanent set remained after the standard treatment of hand winding the fiber onto a 0.5 inch diameter glass mandrel, treating it with bromine, debrominating it, unwinding it from the mandrel, and testing it.

The action of plasticization followed by deplasticization has no significant effect on the mechanical properties of scoured carbon fibers or on their composite properties. If unscoured yarns are treated with plasticizing agent, the agent can interact with the finish on the fiber as well as the fiber itself. In some cases, an improvement in crimp index and in composite interlaminar shear strength have been observed when the finish and surface contaminants are not removed prior to plasticization.

The effect of plasticizing several carbon fibers is given in the following examples:

EXAMPLE I

Carbon fibers were scoured at room temperature by treatment in concentrated hydrofluoric acid (HF) for 30 minutes, flushed with cold tap water, then dried at 48° C. for 25 hours after which no HF odor was detectable. To ensure that complete bromination occurred in this test, the samples were immersed in liquid bromine for 24 hours. Because all samples retained some bromine tenaciously, the samples described were placed in an oven at 100° C. for 48 hours to reduce the residual bromine to a minimum. The crimp index for the treated yarns are as follows:

Modmor I, 0.05; Modmor II, 0.05; VYB105, 0.10; Thornel 390, 0.35; Hercules HTS, 0.34; and Celion 70, 0.35.

EXAMPLE II

Carbon fibers were treated by the procedure given in Example I, then subjected to mechanical property tests. The tensile strength and tensile modulus were determined by known methods. The specific conductivity is another measure of the modulus of the fibers. The test fibers were exposed to bromine whereas the control fibers were not exposed to bromine but otherwise were treated by exactly the same procedure. The results given in the accompanying table show no significant effect of plasticization on the tensile properties of the fibers:

| Fiber | Tensile strength Test/control ($10^{+3}$ psi) | Tensile Modulus Test/control ($10^{+6}$ psi) | Specific Conductivity Test/control $(ohm/cm)^{-1}$ |
|---|---|---|---|
| Celion 70 | 145/152 | 47.3/47.1 | 1560/1580 |
| Thornel 390 | 106/109 | 34.5/36.9 | 1230/1200 |

EXAMPLE III

Undirectional composites of fibers in Shell 828 Epoxy with Epon D curing agent were fabricated in a mold under nominal pressure and cured at 100° C. for 4 hours. The test and control fibers were treated as set forth in Example II. The interlaminar shear strength was determined by known methods with a span/depth ratio of 6. The results given in the accompanying table show no significant effect of plasticizer on the interlaminar shear strength of composites:

| Fiber | Interlaminar Shear Strength Test/control ($10^{+3}$ psi) |
|---|---|
| Thornel 390 | 8.34/8.29 |
| Modmor I | 9.23/9.38 |

The process of the present invention has enabled carbon fibers treated with a plasticizing agent to be subjected to mechanical operations which would otherwise damage the fiber. The fiber while in the plasticized state can be forced into shapes which would cause the unplasticized fiber to break. On removal of the plasticizer while a fiber is constrained to a given configuration, a measurable degree of the configuration will be retained. If the plasticizer is left in the fiber or only partially removed, the fibers have an increased elongation-at-break. This latter effect results in improved impact resistance of composites made from the partially plasticized fiber.

What is claimed as new and desired to be secured by Letters Patent of the United States is:

1. In a method of manufacturing an article containing carbon fibers wherein the fibers are subjected to tortuous mechanical manipulation in order to impart a particular configuration thereto, the improvement comprising contacting said fibers with a plasticizing agent capable of intercalating single crystals of graphite prior to the manipulation of said fibers, and thereafter removing said plasticizing agent, whereby said fibers, after removal of the plasticizing agent, will retain to a measurable degree the configuration imparted thereto during the manipulation.

2. The method of claim 1 wherein the plasticizing agent is selected from the group consisting of bromine and iodine monochloride.

3. The method of claim 2 wherein the carbon fibers are contacted with the plasticizing agent at a temperature in the range of 20° C. to 350° C.

4. The method of claim 3 wherein the plasticizing agent is in liquid form and the fibers are submerged therein.

5. The method of claim 4 wherein the plasticizing agent is bromine.

6. The method of claim 4 wherein the plasticizing agent is iodine monochloride.

7. The method of claim 3 wherein the plasticizing agent is in gas form and the fibers are exposed thereto.

8. The method of claim 3 wherein the plasticizing agent is in solution and the fibers are submerged therein.

9. The method of claim 3 wherein the plasticizing agent is removed by evaporation.

10. The method of claim 3 wherein the plasticizing agent is removed by heating the fibers.

11. The method of claim 3 wherein the plasticizing agent is removed by exposure of the fibers to a vacuum.

12. The method of claim 3 wherein the plasticizing agent is removed by contacting the plasticized fibers with a solvent for plasticizing agent.

13. The method of claim 3 wherein the plasticizing agent is removed by chemical reaction.

14. The method of claim 3 which additionally comprises scouring the carbon fibers prior to contact with the plasticizing agent to remove any coating thereon.

15. The method of claim 14 wherein the scouring is accomplished by treating the fibers with hydrofluoric acid.

16. The method of claim 3 which additionally comprises incorporating the carbon fibers into a resin matrix subsequent to the removal of the plasticizing agent to form a composite.

17. In a method of manufacturing an article containing carbon fibers wherein the fibers are subjected to tortuous mechanical manipulation in order to impart a particular configuration thereto, the improvement comprising contacting said fibers with a plasticizing agent capable of intercalating single crystals of graphite prior to the manipulation of said fibers, and thereafter partially removing said plasticizing agent to produce a fiber possessing an increased elongation-at-break as compared to an unplasticized fiber.

18. The method of claim 17 wherein the plasticizing agent is selected from the group consisting of bromine and iodine monochloride.

19. The method of claim 18, wherein the carbon fibers are contacted with the plasticizing agent at a temperature in the range of 20° C. to 350° C.

20. The method of claim 19 wherein the plasticizing agent is in liquid form and the fibers are submerged therein.

21. The method of claim 20 wherein the plasticizing agent is bromine.

22. The method of claim 20 wherein the plasticizing agent is iodine monochloride.

23. The method of claim 18 which additionally comprises incorporating the carbon fibers into a resin matrix subsequent to the partial removal of the plasticizing agent to produce a composite possessing increased impact resistance as compared to composites containing carbon fibers which contain no plasticizing agent.

* * * * *